US006844851B2

(12) United States Patent
Yoon et al.

(10) Patent No.: US 6,844,851 B2
(45) Date of Patent: Jan. 18, 2005

(54) PLANAR ANTENNA HAVING LINEAR AND CIRCULAR POLARIZATION

(75) Inventors: Won-Sang Yoon, Seoul (KR); Gennadi Yevtyushkin, Suwon-si (KR)

(73) Assignee: Samsung Thales Co., Ltd., Gumi (KR)

( * ) Notice: Subject to any disclaimer, the term of this patent is extended or adjusted under 35 U.S.C. 154(b) by 0 days.

(21) Appl. No.: 10/259,522

(22) Filed: Sep. 30, 2002

(65) Prior Publication Data

US 2003/0218571 A1 Nov. 27, 2003

(30) Foreign Application Priority Data

May 27, 2002 (KR) ..... 2002-29322

(51) Int. Cl.[7] ..... H01Q 1/38

(52) U.S. Cl. ..... 343/700 MS; 343/795; 343/805; 343/810

(58) Field of Search ..... 343/700 MS, 793, 343/795, 805, 810, 814, 816, 820, 822, 853, 893

(56) References Cited

U.S. PATENT DOCUMENTS

| | | | | |
|---|---|---|---|---|
| 3,587,110 A | * | 6/1971 | Woodward | 343/813 |
| 4,475,107 A | | 10/1984 | Makimoto et al. | 343/700 MS |
| 4,614,947 A | | 9/1986 | Rammos | 343/778 |
| 4,816,835 A | | 3/1989 | Abiko et al. | 343/700 MS |
| 4,922,263 A | | 5/1990 | Dubost et al. | 343/797 |
| 5,005,019 A | | 4/1991 | Zaghloul et al. | 343/700 MS |
| 5,241,321 A | | 8/1993 | Tsao | 343/700 MS |
| 5,321,411 A | | 6/1994 | Tsukamoto et al. | 343/700 MS |
| 5,510,803 A | | 4/1996 | Ishizaka et al. | 343/700 MS |
| 6,034,649 A | * | 3/2000 | Wilson et al. | 343/795 |
| 6,037,911 A | * | 3/2000 | Brankovic et al. | 343/795 |
| 6,107,956 A | | 8/2000 | Russell et al. | 342/70 |
| 6,166,701 A | | 12/2000 | Park et al. | 343/771 |
| 6,285,336 B1 | * | 9/2001 | Zimmerman | 343/803 |
| 6,396,456 B1 | | 5/2002 | Chiang et al. | 343/795 |
| 2002/0005811 A1 | | 1/2002 | Tsai et al. | 343/795 |

FOREIGN PATENT DOCUMENTS

| | | |
|---|---|---|
| EP | 0 342 175 A2 | 11/1989 |
| EP | 0 342 175 A3 | 11/1989 |
| EP | 0 889 543 A1 | 6/1997 |
| JP | 62-122304 | 6/1987 |
| WO | WO 02 091517 A1 | 11/2002 |

OTHER PUBLICATIONS

"*Search Report under Section 17*" dated on Apr. 11, 2003, and "*Combined Search Examination Report under Section 18 (3)*" dated on Apr. 14, 2003 issued by U.K. Patent Office.

Jean–Pierre R. Bayard et al.; "Scan Performance of Infinite Arrays of Microstrip–FED Dipoles with Bent Arms Printed on Protruding Substrates"; IEEE Transactions on Antennas and Propagation, IEEE Inc. New York, US, vol. 43, No. 8, pp. 884–888, Aug. 1995.

Yu–De Lin et al.; "Analysis and Design of Broadside–Coupled Striplines–Fed Bow–Tie Antennas"; IEEE Transactions on Antennas and Propagation, IEEE Inc. New York, US, vol. 46, No. 3, pp. 459–460, Mar. 1998.

* cited by examiner

*Primary Examiner*—Shih-Chao Chen
(74) *Attorney, Agent, or Firm*—Robert E. Bushnell, Esq.

(57) ABSTRACT

An antenna is located at the end of a wireless communication system, or other radio system, and more particularly, a wideband planar antenna with linear and circular polarization uses different polarization for transmission or reception to increase the isolation between the transmission and reception by suggestion and using a type of radiation element. The disclosed antenna is more efficient than other similar antennas that can transmit/receive linear or circular polarization. The disclosed invention makes it possible to pr vide an antenna having dual polarization, which has an orthogonal characteristic in both linear and circular polarization, and which can lower the height of the antenna by embodying a micro strip planar antenna which has linear and circular polarization that has high gain over a wide frequency band, and which transmits/receives linear or circular polarization.

16 Claims, 11 Drawing Sheets

PLANAR ANTENNA HAVING LINEAR AND CIRCULAR POLARIZATION

CLAIM OF PRIORITY

This application claims priority to an application entitled "PLANNER ANTENNA HAVING LINEAR AND CIRCULAR POLARIZATION", filed in the Korean Industrial Property Office on May 27, 2002 and assigned Serial No. 2002-29322, the contents of which are hereby incorporated by reference.

BACKGROUND OF THE INVENTION

1. Technical Field

The present invention relates to an antenna that is located at the end of a wireless communication system, or other radio system, and more particularly, to a wideband planar antenna having linear and circular polarization, which uses different polarization for transmission and reception to increase the isolation between transmission and reception by suggesting and using a type of a radiation element.

2. Related Art

A dish antenna is commonly used for a satellite communication service because the dish antenna has a simple structure and it can easily form dual circular polarization. Dish antennas are sometimes cumbersome due to their bulkiness. For this reason, various kinds of planar array antennas with a low height have been introduced. However, most planar antennas can only utilize one of linear and circular polarization, not both.

This characteristic limits the use of the planar antenna such that the antenna cannot be used for both transmission and reception. In most cases, planar array antennas for satellite communication are used only for the purpose of reception.

I have found that there are disadvantages to current dish antennas and current planar antennas. Efforts have been made to improve antennas.

Exemplars of recent efforts in the art include U.S. Pat. No. 4,475,107 for CIRCULARLY POLARIZED MICROSTRIP LINE ANTENNA issued on Oct. 2, 1984 to Makimoto et al., U.S. Pat. No. 4,816,835 for PLANAR ANTENNA WITH PATCH ELEMENTS issued on Mar. 28, 1989 to Abiko et al., U.S. Pat. No. 4,614,947 for PLANNER HIGH-FREQUENCY ANTENNA HAVING A NETWORK OF FULLY SUSPENDED-SUBSTRATE MICROSTRIP TRANSMISSION LINES issued on Sep. 30, 1986 to Rammos, U.S. Pat. No. 6,166,701 for DUAL POLARIZATION ANTENNA ARRAY WITH RADIATIN SLOTS AND NOTCH DIPOLE ELEMENTS SHARING A COMMON APERTURE issued on Dec. 26, 2000 to Park et al., U.S. Pat. No. 5,241,321 for DUAL FREQUENCY CIRCULARLY POLARIZED MICROWAVE ANTENNA issued on Aug. 31, 1993 to Tsao, U.S. Pat. No. 6,107,956 for AUTOMOTIVE FORWARD LOOKING SENSOR ARCHITECTURE issued on Aug. 22, 2000 to Russell et al., U.S. Pat. No. 4,922,263 for PLATE ANTENNA WITH DOUBLE CROSSED POLARIZATIONS issued on May 1, 1990 to Dubost et al., U.S. Pat. No. 5,005,019 for ELECTROMAGNETICALLY COUPLED PRINTED-CIRCUIT ANTENNAS HAVING PATCHES OR SLOTS CAPACITIVELY COUPLED TO FEEDLINES issued on Apr. 2, 1991 to Zaghloul et al., and U.S. Pat. No. 5,321,411 for PLANAR ANTENNA FOR LINEARLY POLARIZED WAVES issued on Jun. 14, 1994 to Tsukamoto et al.

While these recent efforts provide advantages, I note that they fail to adequately provide an improved planar anntenna having linear and circular polarization.

SUMMARY OF THE INVENTION

To solve the above-described problems, it is an object of the present invention to provide an antenna having linear and circular polarization, which uses dipoles as radiation elements, and has an orthogonal characteristic in both linear and circular polarization, the antenna being embodied by using two plates and the front and back sides of the plates effectively.

An object of the present invention is to provide a planar antenna having linear and circular polarization, comprising: a plate with a conductor coated on both surfaces of a dielectric substance; a first branch positioned on a first surface of the plate; and a second branch positioned on a second surface of the plate.

Another object of the present invention is to provide a planar antenna having linear and circular polarization, comprising: a first plate with a conductor coated on both surfaces of a dielectric substance; a second plate with a conductor coated on both sides of the dielectric substance, the second plate being positioned under the first plate; a plurality of first symmetrical radiation elements which are on both surfaces of the first plate, for transmitting or receiving a radio wave; a plurality of second symmetrical radiation elements which are on both surfaces of the second plate, for transmitting or receiving a radio wave; a ground plate which supports the whole antenna and is used as a ground for the entire circuit; and a support for supporting the whole antenna by connecting the overlapped first and second plates and the ground plate.

Still another object of the present invention is to provide a radiation element comprising two branches and one stem, wherein the branches meet at the stem at an angle of 45° to the surface that is perpendicular to the stem, and the branches are in the shape of a symmetric dipole.

The present invention discloses a planar antenna that accommodates either linear or circular polarization having an orthogonal characteristic during transmission and reception in a wideband. By using two folds of printed-circuit-board type plates, the antenna of the present invention can minimize insertion loss, weight, and thickness. However, since isolated radiation elements are insufficient, the frequency band has a limitation.

The planar antenna of the present invention comprises a ground plate, two micro strip plates, and a support for connecting the ground plate and the micro strip plates. The space between the plates and the support is filled with a material such as polystyrene foam.

On each plate, there are dipoles, which are radiation elements, power supply circuits, slots, and stubs. The entire antenna is divided into rooms in the shape of a lattice, in which a ground circuit surrounds a pair of dipoles. The collection of lattice-shaped rooms is called a subarray. The subarrays positioned on the same surface have linear polarization characteristics independently from each other. Since the dipoles of each subarray are orthogonal to each other, the polarization vectors of two subarrays are orthogonal to each other. In addition, a subarray has an independent power supply circuit, and since the coupling of the orthogonal dipoles is very small, various forms of polarization can be embodied depending on how the subarrays are connected.

The power supply circuit in a single subarray includes a 90° phase shifter. Accordingly, the polarization of each of the subarrays combines to form circular polarization. The power supply circuit is connected to each of the subarrays and the power supply connections are orthogonal to each other. A termination of a subarray is connected to a circular waveguide through a probe, and it excites the Transverse Electric 11 (TE11) mode. Therefore, the two modes before and after the excitation are orthogonal to each other, and the overall mode is determined by overlapping the two modes. The polarization slope of the overall mode determines the correlations between the signal powers of orthogonal modes, and by the result of it, the polarization characteristic of an antenna is determined.

In other words, if Transverse Electric 11 (TE11) mode signals connected to the subarrays have the same linear polarization, the overall polarization has a characteristic of linear polarization, and if the phase difference of the Transverse Electric 11 (TE11) mode signals connected to the subarrays is 90°, the overall polarization has a characteristic of circular polarization. A single subarray has a characteristic of linear polarization.

To achieve these and other objects in accordance with the principles of the present invention, as embodied and broadly described, the present invention provides a planar antenna having linear and circular polarization, the antenna comprising: a plate having a dielectric substance with a conductor coated on side surfaces of the dielectric substance; and at least one radiation element comprising: a first branch being positioned on a first surface of said plate; and a second branch being positioned on a second surface of said plate different from the first surface.

To achieve these and other objects in accordance with the principles of the present invention, as embodied and broadly described, the present invention provides a planar antenna having linear and circular polarization, the antenna comprising: a first plate having a first dielectric substance with a conductor coated on side surfaces of the first dielectric substance, said first plate having a first side surface and a second side surface; a second plate having a second dielectric substance with a conductor coated on side surfaces of the second dielectric substance, said second plate having a first side surface and a second side surface, said second plate being under said first plate, said first side surface of said second plate facing said second side surface of said first plate; a plurality of first symmetrical radiation elements being on said first and second side surfaces of said first plate, said first elements performing at least one selected from among transmitting radio waves and receiving radio waves; a plurality of second symmetrical radiation elements being on said first and second side surfaces of said second plate, said second elements performing at least one selected from among transmitting radio waves and receiving radio waves; a ground plate corresponding to a local reference potential for said first and second elements, said ground plate being under said second plate; and a support supporting the antenna by connecting said first plate, said second plate, and said ground plate.

To achieve these and other objects in accordance with the principles of the present invention, as embodied and broadly described, the present invention provides a radiation element, comprising: a pair of branches; and a stem being joined to said pair of branches, each one of said branches forming a 45° angle with a surface that is perpendicular to said stem, said pair of branches corresponding to a symmetric dipole.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE INVENTION

Figure 1:
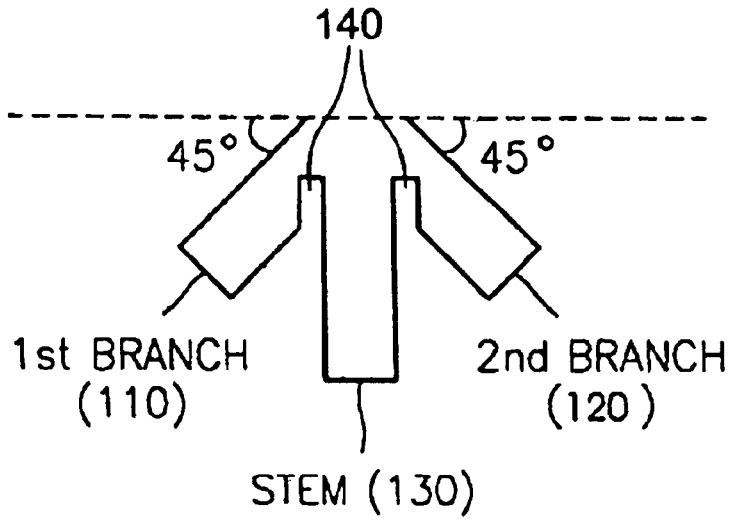
FIG. 1 is a diagram illustrating a radiation element, in accordance with the principles of the present invention.

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions, constructions, and configurations are not described in detail since they could obscure the invention with unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

The present invention will now be described more fully with reference to the accompanying drawings, in which a preferred embodiment of the invention is shown. This invention may be embodied in many different forms and should not be construed as being limited to the embodiment set forth herein; rather, these embodiments are provided so that this disclosure will be thorough and complete and will fully convey the concept of the invention to those skilled in the art. In the drawings, the thickness of the layers and regions are exaggerated for clarity. It will also be understood that when a layer is referred to as being "on" another layer or substrate, it can either be directly on the other layer or substrate or has intervening layers present. The same reference numerals in different drawings represent the same elements, and thus their descriptions will be omitted.

One type of planar antenna can be associated with linearly polarize waves. Such an antenna can include a ground plate, power supply circuit plate, and radiation plate, and has a high gain, but it is used for the purpose of reception only.

Another type of planar antenna can be associated with circular polarization. Such an antenna is used for either transmission or reception due to its single polarization characteristic. Such an antenna will have a generally simple configuration. However, such an antenna does not embody the characteristic of dual polarization.

Some planar radiation elements can form both linear and circular polarization. An antenna that has linear and circular polarization may have all its radiation elements and power supply points existing on one plane, and a requested polarization is embodied by properly exciting in the power supply points. Accordingly, two power supply circuits are needed to obtain two kinds of polarization. This would be made possible by arraying the two power supply circuits appropriately on one plane.

A joint array could address some of the above-mentioned problems. An antenna that relates to a dual polarization antenna array using a common aperture can have the common aperture involving a micro strip dipole array and a plurality of centered slot arrays positioned in the aperture. Such a dual polarization array antenna could have radiation elements in the common apertures and multiple folds of power supply circuits.

Another antenna could have a fully suspended-substrate micro strip line, and two folds of power supply circuits for the common aperture of circular waveguide radiation elements. That type of antenna would be disadvantageous due to the complicated configuration, excessive height, and mechanically delicate fabrication process.

Another planar antenna could be formed of patch elements that make up a complete printed-circuit-board type dual polarization antenna. Such an antenna could be formed of a radiation element circuit unit, first and second power supply circuit units, and a ground plate stacked on one another, each layer being positioned independently by a dielectric substance layer. The patch elements of the radiation element circuit unit could be connected to the power supply circuit unit electromagnetically. Such a planar antenna could use a transmission signal or a reception signal in a different polarization mode, so that the polarization mode of transmission could be different from that of reception, and it could minimize loss so as to obtain high antenna gain.

Referring to FIG. 1, which illustrates a radiation element in accordance with the principles of the present invention, a radiation element has two branches 110 and 120, and a stem 130. Each branch forms an angle of 45° with a surface that is perpendicular to the stem 130, as shown in FIG. 1.

In accordance with the principles of the present invention, the branches 110 and 120 are not required to form an angle that is 45° with the surface that is perpendicular to the stem 130. The branches 110 and 120 could form any angle less than 90° with the surface that is perpendicular to the stem 130.

As shown in FIG. 1, grooves 140 are formed where the ranches 110 and 120 meet the stem 130. Each groove 140 is called a slot, and this is to compensate for the reactance of a dipole. As shown in FIG. 1, each branch 110, 120 meets the stem 130 at a right angle at the region of the slot 140. Each of the branches forms a 90° angle with the stem 130.

Figure 2:
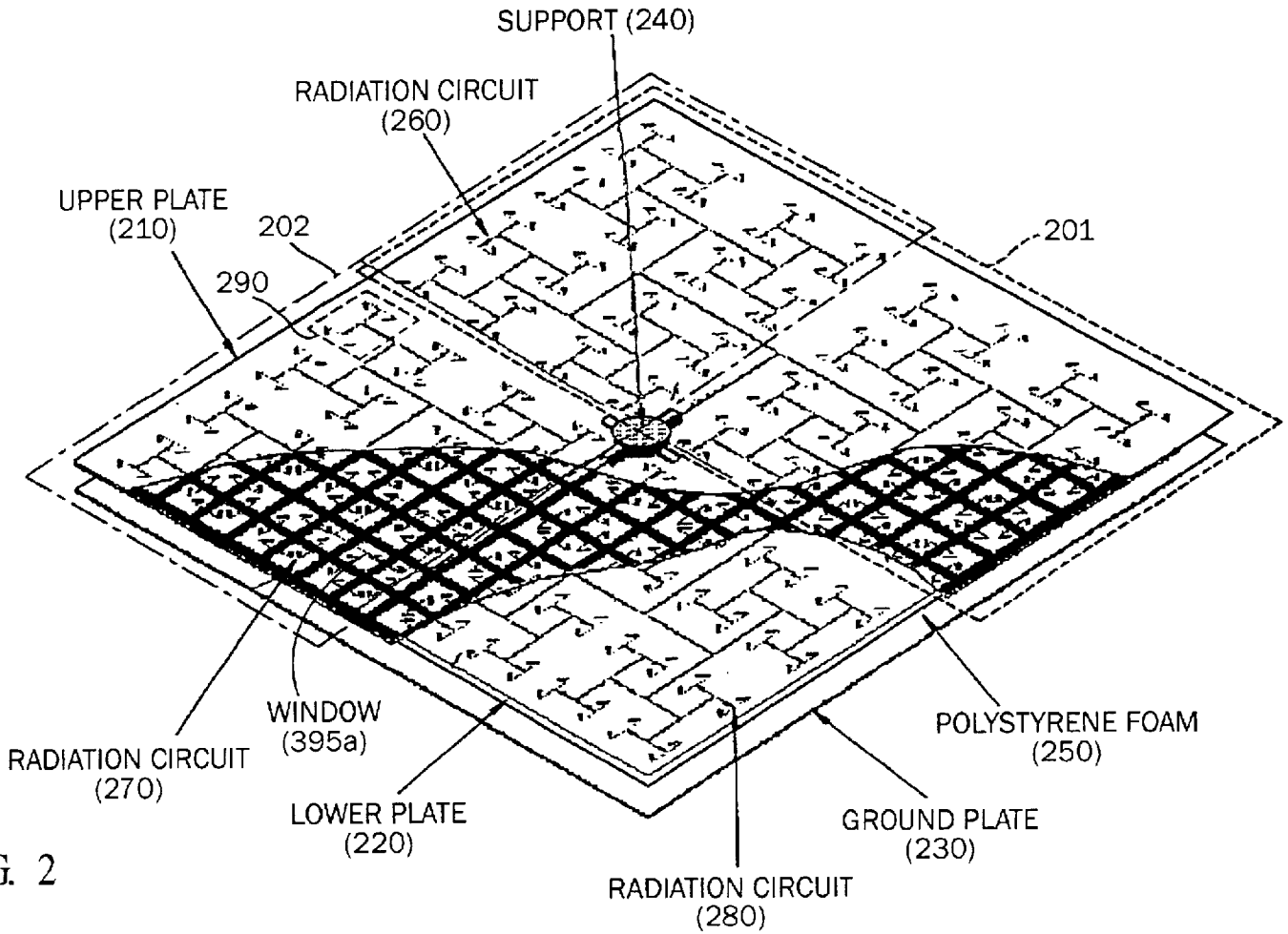
FIG. 2 is a schematic view describing a planar antenna, in accordance with the principles of the present invention.

Referring to FIG. 2, which shows a schematic view of a planar antenna in accordance with the principles of the present invention, the planar antenna of the present invention comprises two plates 210 and 220, a ground plate 230, a support 240 for connecting the plates 210 and 220 and the ground plate 230 at the center, and polystyrene foam 250 for filling the empty space between the lower plate 220 and the ground plate 230.

A circuit unit of the upper plate 210 is formed of a conductor, such as copper (Cu), aluminum (Al), silver (Ag), astatine (At), iron (Fe), and gold (Au), covering the surface of a dielectric substance. Since the side surfaces of the dielectric substance are covered with the conductor, radiation circuits are placed on both sides of the plates, just as a circuit is placed on a printed circuit board (PCB). Radiation circuit 260 is placed on the upper surface of the upper plate 210. Radiation circuit 270 is placed on the lower surface of the upper plate 210. Dielectric substances that can be used here include polyethylene, polyester, acrylic resin, polycarbonate, ammonium bicarbonate (ABC), polyvinyl chloride (PVC), and a mixture thereof. The dielectric substance has an upper side surface and a lower side surface.

The lower plate 220 and the upper plate 210 are formed in a similar manner. Radiation circuit 270 is placed on the upper surface of the lower plate 220. Radiation circuit 280 is placed on the lower surface of the lower plate 220. One part of radiation circuit 270 may be placed on the lower surface of the upper plate 210, and another part of radiation circuit 270 may be placed on the upper surface of the lower plate 220. In some cases, the entire radiation circuit 270 may be placed on the lower surface of the upper plate 210, or the entire radiation circuit 270 may be placed on the upper surface of the lower plate 220. Thus, if the entire radiation circuit 270 is placed on the lower surface of the upper plate 210, then the radiation circuit 270 does not exist on the upper surface of the lower plate 220.

The ground plate 230 is made of aluminum (Al). It supports the entire antenna and it is used as a ground of all of the circuits. The support 240 connects the two plates 210 and 220 and the ground plate 230. Within the support 240 exists a probe, and the probe is connected to the termination of the power supply circuit connected to the power supply circuit of each radiation element. A more detailed description will be provided with reference to FIG. 3.

Between the lower plate 220 and the ground plate 230 is a supporting substance such as polystyrene foam 250 for supporting the antenna. The supporting substance 250 also performs a function of insulating the ground plate 230 from the other plates 210 and 220.

A middle layer can exist between the lower surface of the upper plate 210 and the upper surface of the lower plate 220.

The upper plate 210 has an upper surface and a lower surface. The upper and lower surfaces of the upper plate 210 can be referred to as an upper side surface and a lower side surface, or can be referred to merely as side surfaces of the upper plate 210.

The lower plate 220 has an upper surface and a lower surface. The upper and lower surfaces of the lower plate 220 can be referred to as an upper side surface and a lower side surface, or can be referred to merely as side surfaces of the lower plate 220.

Figure 3:
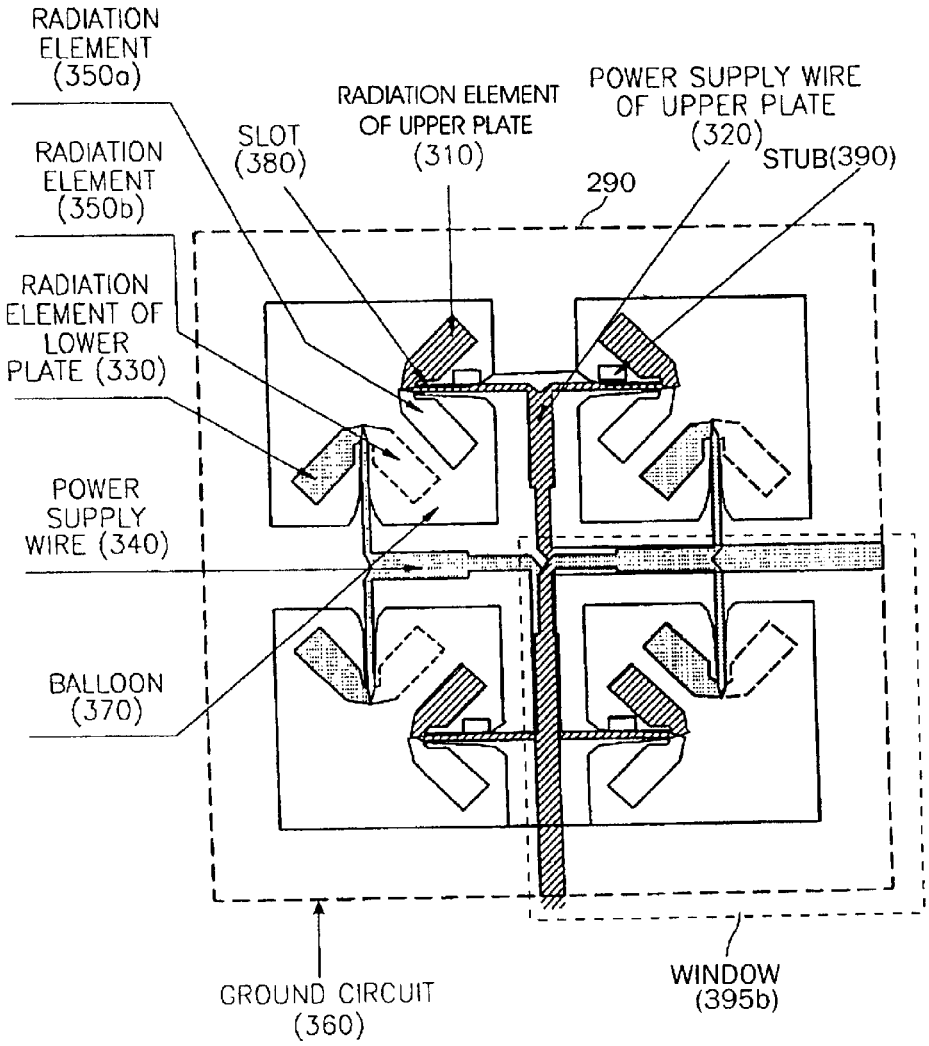
FIG. 3 is a diagram showing a radiation circuit in a 2×2 subarray of the planar antenna, in accordance with the principles of the present invention.

FIG. 3 illustrates a radiation circuit in a 2×2 subarray of the planar antenna in accordance with the principles of the present invention. The items shown in FIG. 3 include radiation elements and other components located on various layers of the plates 210 and 220, and located between those plates. If someone could see directly through the plates 210 and 220, then they would be able to see the items included in FIG. 3.

The items in FIG. 3 are surrounded by a dotted line 290. The dotted line 290 is also shown in FIG. 2. The dotted line 290 in FIG. 2 surrounds 4 branches on the upper surface of the upper plate 210. That is, the dotted line 290 in FIG. 2 surrounds four radiation elements on the upper surface of the upper plate 210. The dotted line 290 shown in FIG. 3 surrounds 16 branches (that is, 16 radiation elements) because FIG. 3 shows all radiation elements on all surfaces of the plates 210 and 220. The 16 radiation elements shown in FIG. 3 include the 4 radiation elements shown in the dotted line 290 in FIG. 2.

The 16 radiation elements in FIG. 3 are surrounded by a ground circuit 360. The ground circuit 360 is approximately at the location of the dotted line 360, and thus is in the shape of a square or a large window. The ground circuit 360 includes 4 square-shaped ground circuits. Each one of the 4 square-shaped ground circuits surrounds 4 radiation elements, as shown in FIG. 3. In FIG. 3, one of the 4 square-shaped ground circuits is surrounded by the dotted line 395*b* (window 395*b*). The window 395*b* shown in FIG. 3 is similar to the thick black squares shown in FIG. 2. The window 395*b* of portion 290 is not shown in FIG. 2. However, a differently located window 395*a* is indicated in FIG. 2. The window 395*a* in FIG. 2 is very similar to the window 395*b* in FIG. 3, except window 395*a* is located in a different position than window 395*b*.

In FIG. 3, the parts 310 and 320 hatched with oblique lines represent a circuit on the upper surface of the upper plate 210. The circuit unit is formed of radiation elements 310 and power supply wires 320. The parts 330 and 340 filled with grey cal in the drawing correspond to a circuit located on the bottom surface of the lower plate 220. This circuit unit is formed of radiation elements 330 and power supply wires 340, just as in the upper plate 210. The parts 350 and 360 that are not filled with any hatching or color indicate circuits located on the bottom surface of the upper plate 210 and the upper surface of the lower plate 220. These circuits include radiation elements 350 and ground circuits 360.

Figure 4:
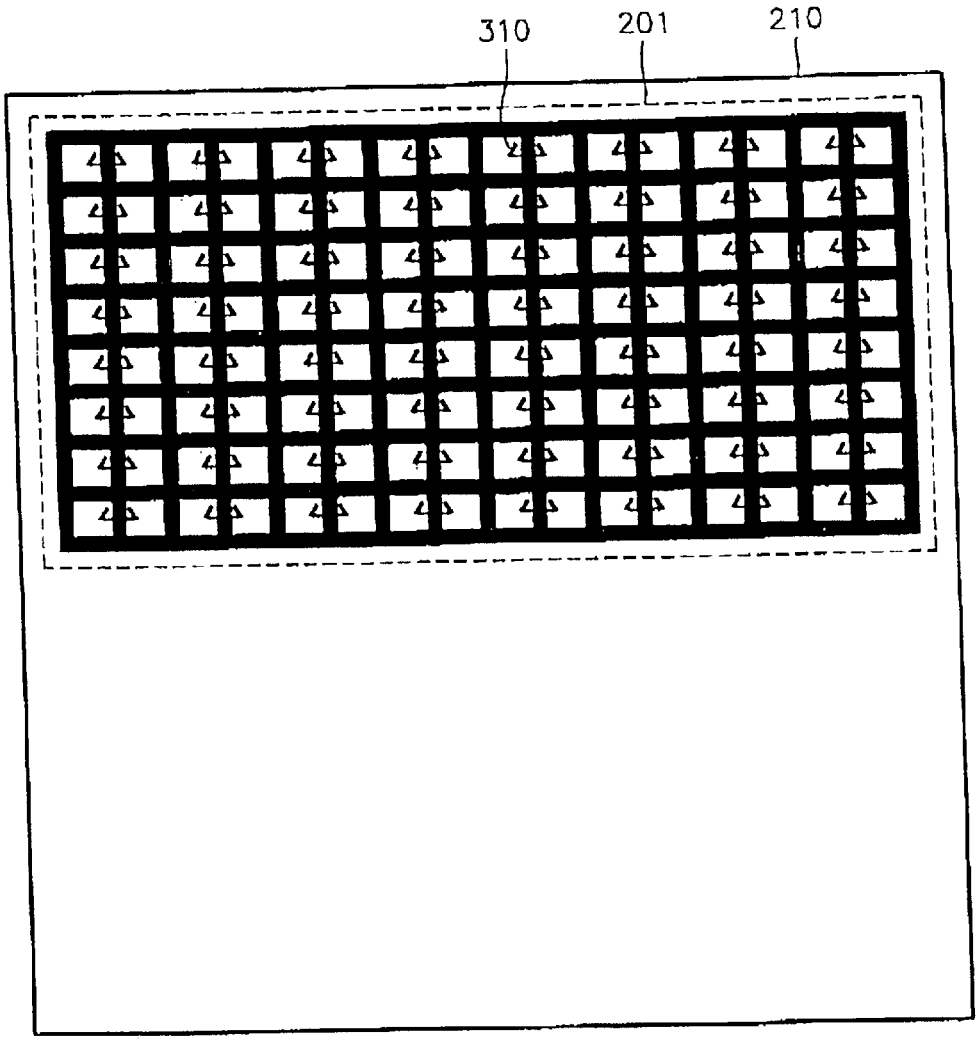
FIG. 4 is a diagram depicting the arrangement of dipoles on the upper surface of the upper plate, in accordance with the principles of the present invention.
Figure 5:
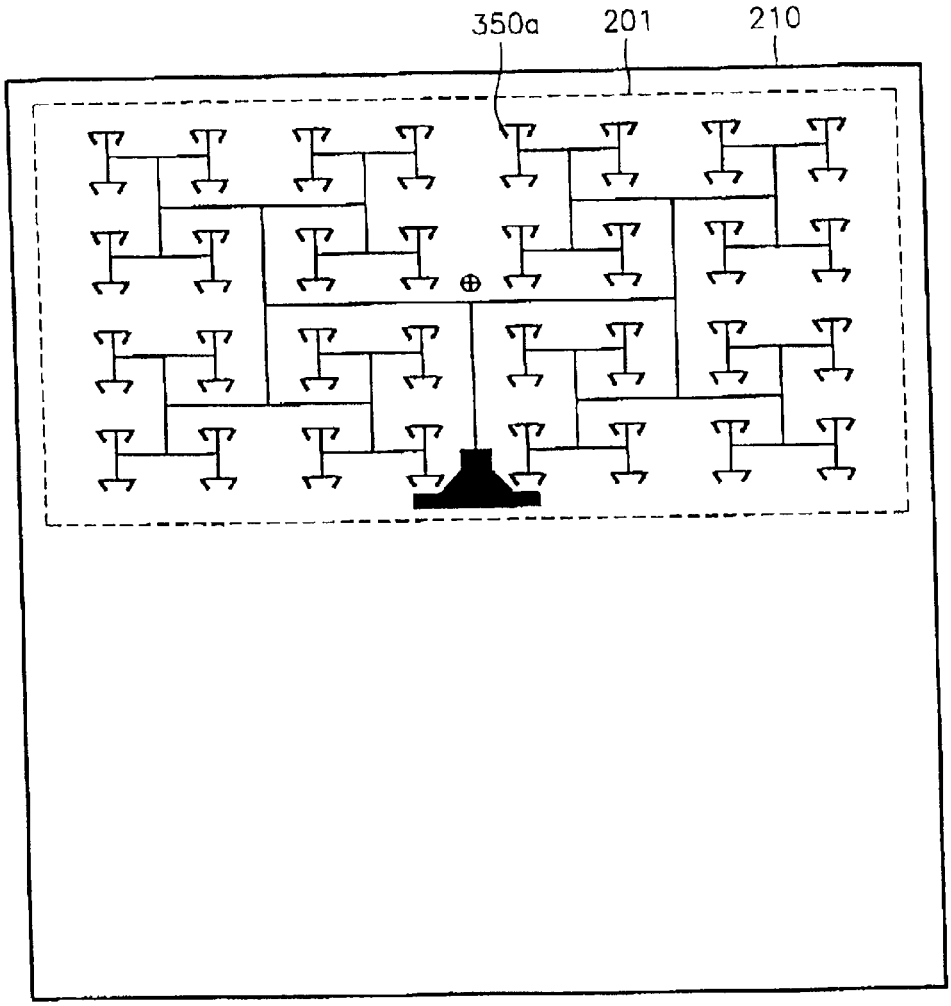
FIG. 5 is a diagram depicting the arrangement of dipoles on the lower surface of the upper plate, in accordance with the principles of the present invention.

The radiation elements located at both sides of the plates are in the form of a symmetrical dipole. One branch 310 of the dipole lies on one surface of the upper plate 210 with the power supply wire 320, and the other branch 350*a* lies on the ground circuit 360, which is on the opposite surface of the upper plate 210. Accordingly, one branch 310 of the dipole and the other branch 350*a* corresponding thereto are located at opposite surfaces of a plate 210. That is, a subarray has dipoles arranged on one side of a plate 210 as shown in FIG. 4 and another subarray has dipoles arranged on the other side of the plate 210 as shown in FIG. 5, so that the dipoles of the subarrays overlap with each other. Unlike general dipoles, the branches of the dipoles are formed at an angle of 45° to obtain optimal performance. In accordance with the principles of the present invention, the dipole branches are bent at 45° to reduce the dipole area. However, in general, dipoles are not bent.

The other plate 220 is just the same as the plate 210 described above. In other words, one branch 330 of the dipole lies on one surface of the plate 220 with the power supply wire 340, and the other branch 350*b* lies on the ground circuit 360, which is on the opposite surface of the plate 220. Accordingly, one branch 330 of the dipole and the other branch 350*b* of the same dipole are located on opposite sides of a plate 220. That is, a subarray has a shape in which the dipoles of FIG. 6 and the dipoles of FIG. 7 overlap in the plate. Unlike general dipoles, the branches of the dipoles are formed bent at an angle of 45° to obtain optimal performance. In accordance with the principles of the present invention, the dipole branches are bent at 45° to reduce the dipole area. However, in general, dipoles are not bent.

The power supply wires 320 and 340 are converted into micro strip lines through a balloon 370. A slot 380 is formed to compensate for the reactance of the dipole. It is formed in the shape of a groove where the branches of the dipole are bent. A stub 390 is formed to compensate for the coupling impedance, and it is positioned at the branch of the dipole. All the dipoles are supplied with power through the branch power supply wires, which diverge from the main power supply wire.

Figure 13:
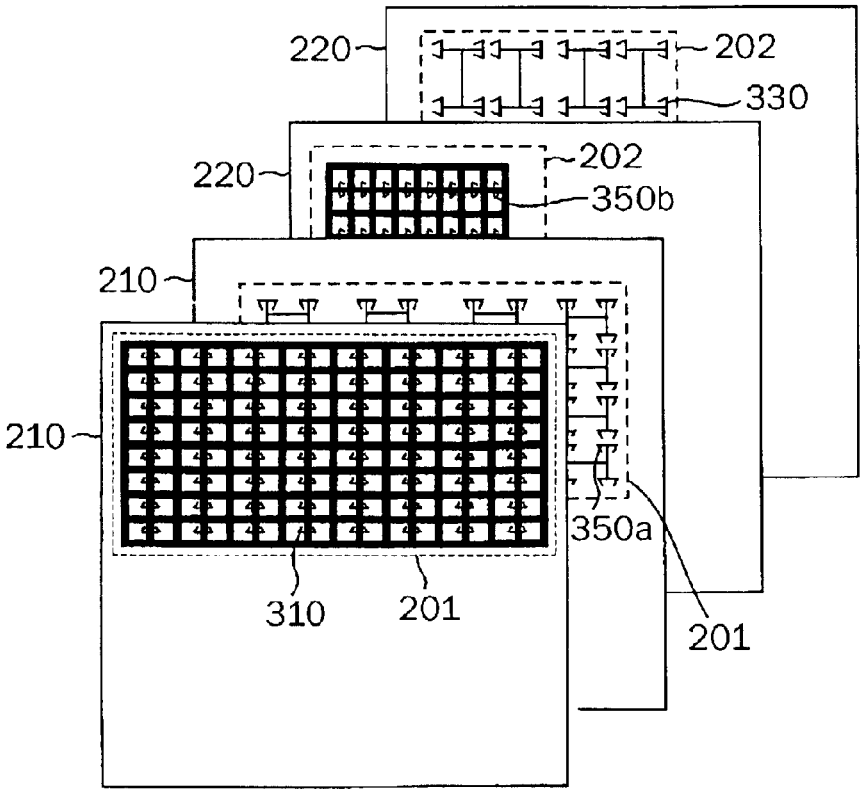
FIG. 13 is a view showing a general arrangement and orientation of the components of FIGS. 4–7 stacked up in order, in accordance with the principles of the present invention.

FIG. 4 is a diagram depicting the arrangement of dipoles on the upper surface of the upper plate 210, in accordance with the principles of the present invention. FIG. 4 show that the radiation elements 350*a* of the upper plate 210 shown in FIG. 3 are arranged in one subarray. FIG. 5 is a diagram depicting the arrangement of dipoles on the bottom surface of the upper plate 210, in accordance with the principles of the present invention. That is, the drawing show that the radiation elements 310 of the upper plate 210 shown in FIG. 3 are arranged on one subarray. Each square window in portion 201 in FIG. 5 is a ground window containing a pair of dipoles (that is, containing 4 radiation elements). Each square window in FIG. 5 only shows a part of one dipole. When the 4 surfaces are stacked up on top of each other, as shown in FIG. 13, then it is apparent that each square window has a pair of dipoles as depicted in window 395*b* in FIG. 3.

Figure 6:
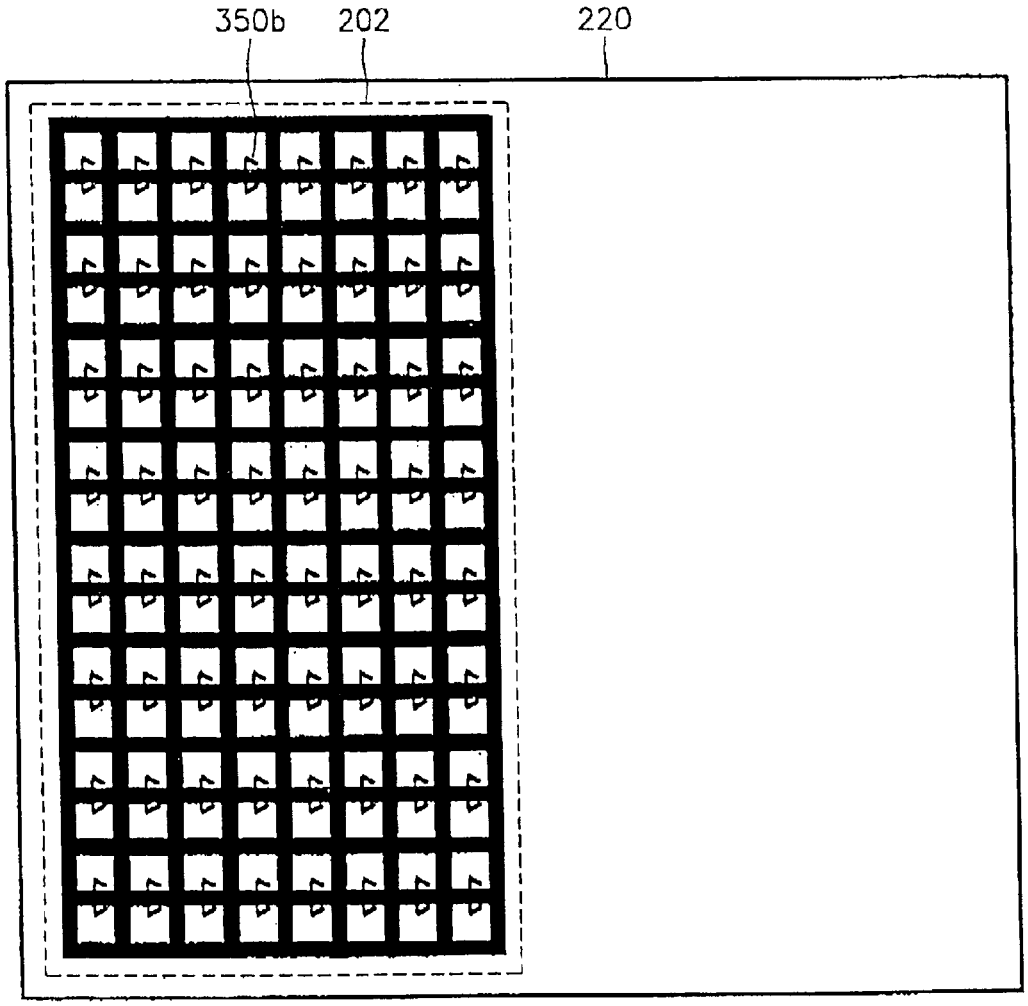
FIG. 6 is a diagram depicting the arrangement of dipoles on the upper surface of the lower plate, in accordance with the principles of the present invention.
Figure 7:
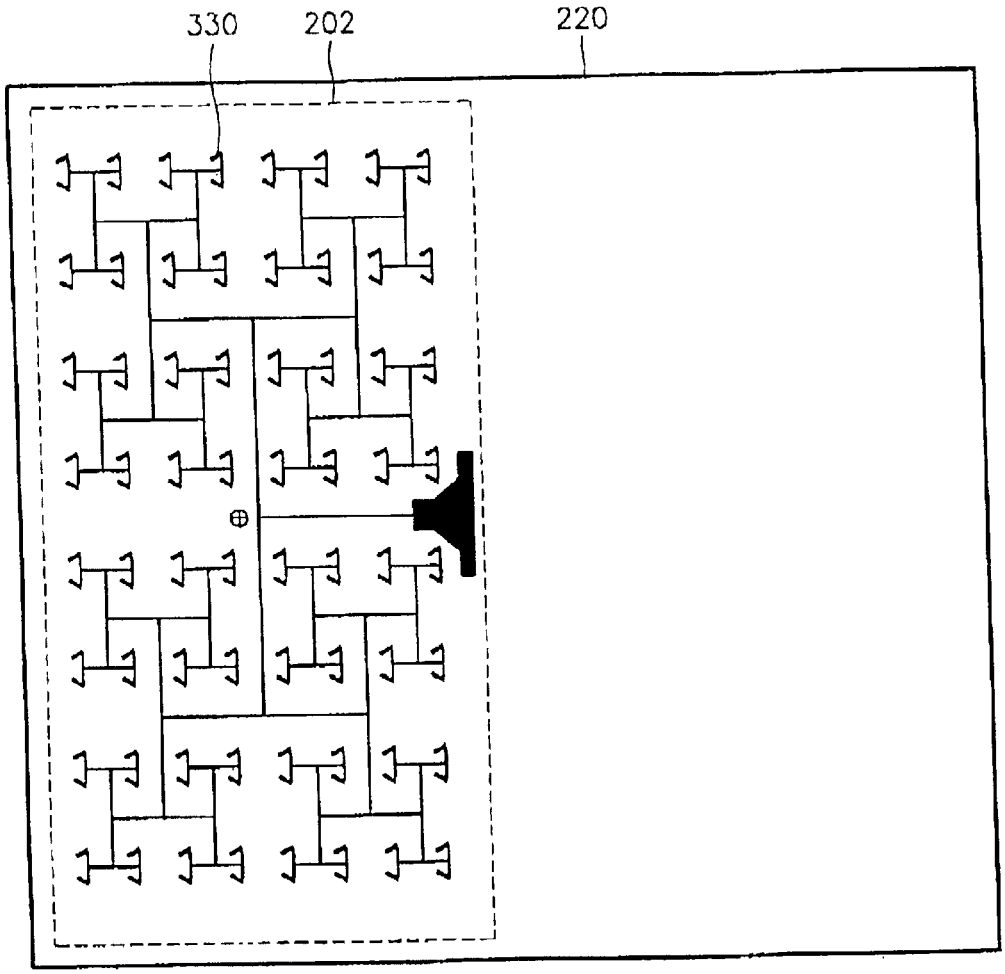
FIG. 7 is a diagram depicting the arrangement of dipoles on the lower surface of the lower plate, in accordance with the principles of the present invention.

FIG. 6 is a diagram depicting the arrangement of dipoles on the upper surface of the lower plate 220, in accordance with the principles of the present invention. The drawing shows that the radiation elements 350*b* of the lower plate shown in FIG. 3 are arranged in one subarray. FIG. 7 is a diagram depicting the arrangement of dipoles on the bottom surface of the lower plate 220, in accordance with the principles of the present invention. It shows that the radiation elements 330 of the lower plate shown in FIG. 3 are arranged in one subarray.

When the dipoles of FIGS. 4 through 7 are stacked up in order, the dipole arrangement of the planar antenna of the present invention is formed. FIG. 13 is a view showing the general arrangement and orientation of the components of FIGS. 4–7 stacked up in order, in accordance with the principles of the present invention.

Figure 8:
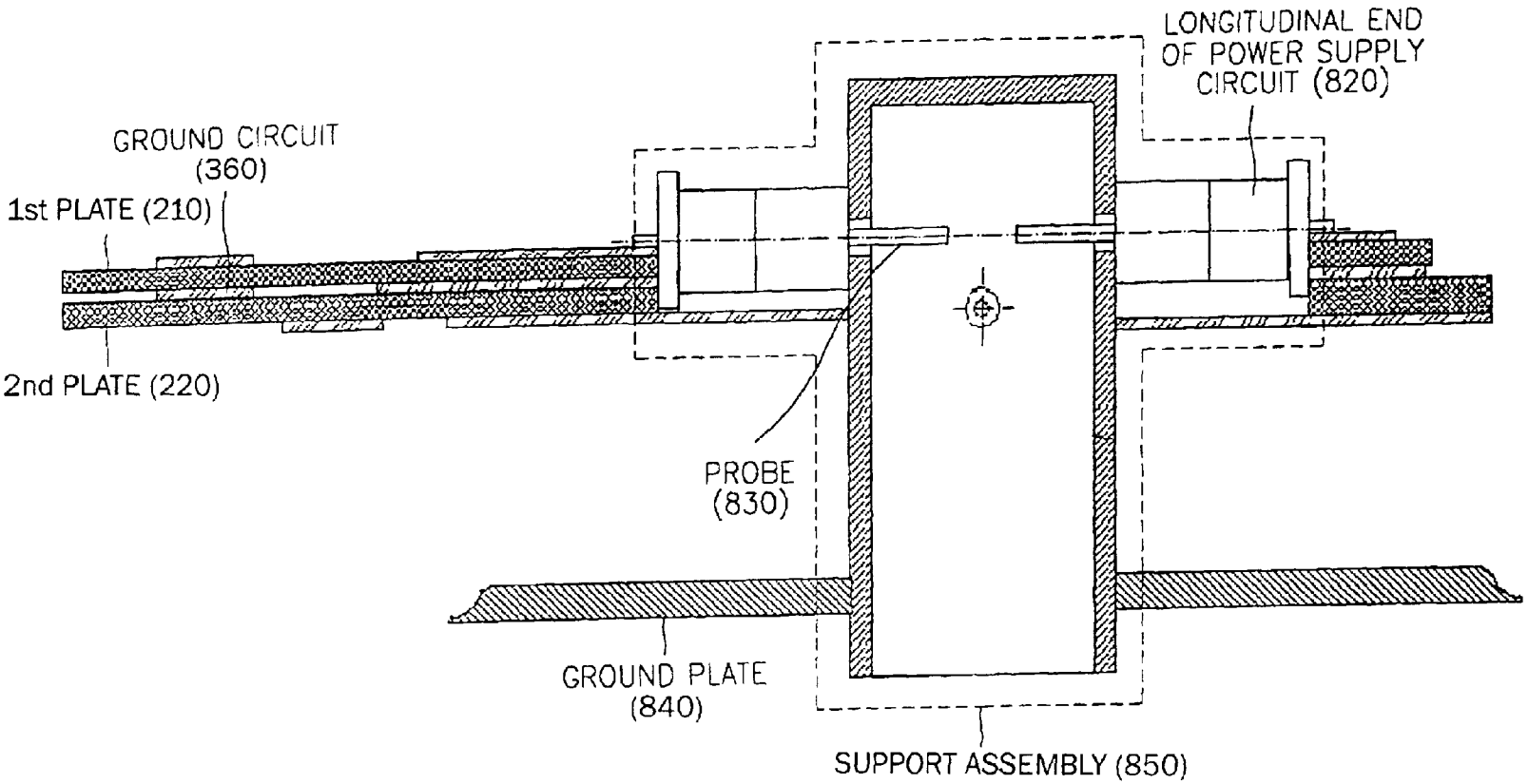
FIG. 8 is a side view of the planar antenna, in accordance with the principles of the present invention.

FIG. 8 is a side view of a planar antenna formed in accordance with the principles of the present invention. The ground circuit 360 is embodied in the form of a window surrounding the dipoles. For example, FIG. 3 shows a window 295*b* with two dipoles in the window 395*b*. All of the ground windows include a pair of dipoles that are orthogonal to each other. The windows minimize the effect of the dipole radiation on a screen circuit. The ground windows form a lattice, and the power supply wires are arranged on the windows. Accordingly, two plates with a similar dipole arrangement form a subarray of a separate antenna, and two folds of subarrays, which are orthogonal to each other, form an antenna. FIG. 8 shows the longitudinal end of power supply circuit 820, probe 830, ground plate 840, and support assembly 850. The support assembly 850 corresponds generally to the support 240 shown in FIG. 2.

A power supply wire for one subarray is positioned on the upper plate 210, and a power supply wire for the other subarray is positioned on the lower plate 220. The ground circuit 360 is located between the two plates 210 and 220, and it is for both use for both subarrays.

The ground windows should be sufficiently thicker than the power supply wire to reduce the coupling between the power supply wires for the subarrays. The power supply circuit for each plate includes a phase shifter embodied with a micro strip line stub to have a phase difference of 90° with respect to the corresponding subarray. The phase shifter used here is a conventional phase shifter. In this case, when the two subarrays both operate, circular polarization can be obtained, whereas when only one subarray operates, linear polarization is obtained.

The termination 820 of the power supply circuit is located at the center of each plate, and the termination of the upper plate 210 is positioned to be orthogonal to the termination of the lower plate 220. The terminations 820 are connected to the probes 830 located at the center of the array antenna. Accordingly, all the subarrays include a pair of terminations in the same direction.

The pair of terminations is excited by the Transverse Electric 11 (TE11) mode of a circular waveguide combiner through the probes 830. When the two pairs of terminations 820 are orthogonal to each other, the two Transverse Electric 11 (TE11) modes become orthogonal to each other too.

Figures 9A, 9B:
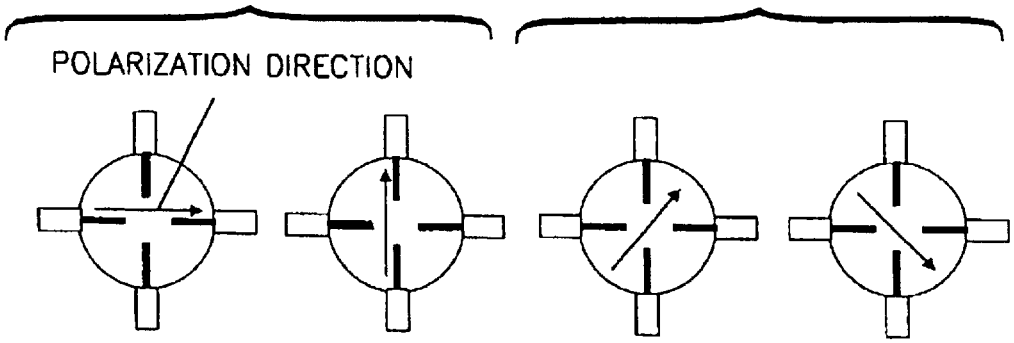
FIGS. 9A and 9B are diagrams showing the probe and the polarization propagating direction of the planar antenna, in accordance with the principles of the present invention.

FIGS. 9A and 9B are diagrams showing the probe and the polarization propagation direction of the planar antenna in accordance with the principles of the p sent invention. FIG. 9A shows the direction of polarization when the polarization of the Transverse Electric 11 (TE11) mode is parallel to another pair of probes and only one subarray operates. FIG. 9B illustrates the direction of polarization when the polarization of the Transverse Electric 11 (TE11) mode is rotated by 90° with respect to another probe and two subarrays operate. If the phase shifter operates while the two subarrays operate, the polarization of the array antenna becomes circular, either leftward or rightward.

Therefore, the two orthogonal Transverse Electric 11 (TE11) modes always correspond to two types of antenna polarization, i.e., linear (vertical or horizontal) polarization, or circular leftward or rightward polarization. One polarization is used for the purpose of transmission, and the other one is used for reception.

Figure 10:
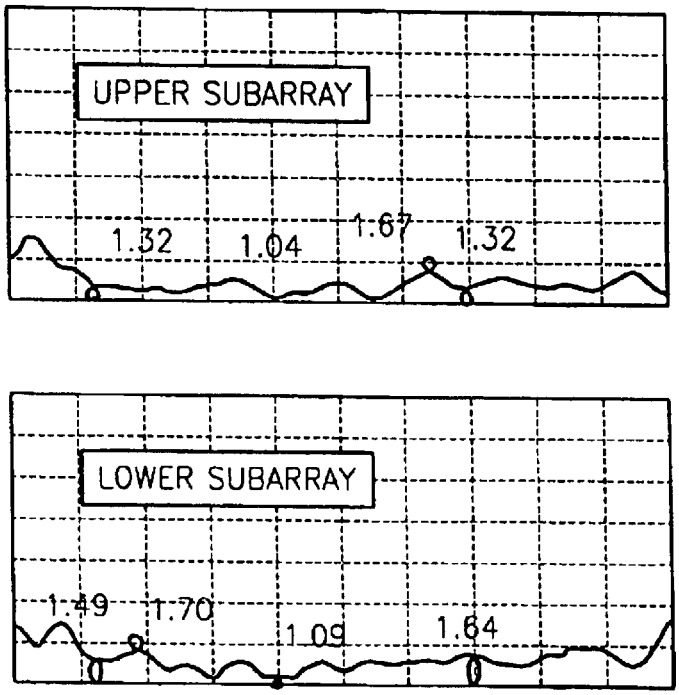
FIG. 10 is a graphical view showing a voltage standing wave ratio of the upper and lower plates of the planar antenna, in accordance with the principles of the present invention.

FIG. 10 is a graphical view showing a voltage standing wave ratio (VSWR) of the upper plate and the lower plate of the planar antenna, in accordance with the principles of the present invention. The voltage standing wave ratio (VSWR) is measured in the bandwidth of 7.25 gigahertz (GHz) to 8.4 GHz. As shown in the drawing, the maximum value of the voltage standing wave ratio (VSWR) is under 1.7.

Figure 11:
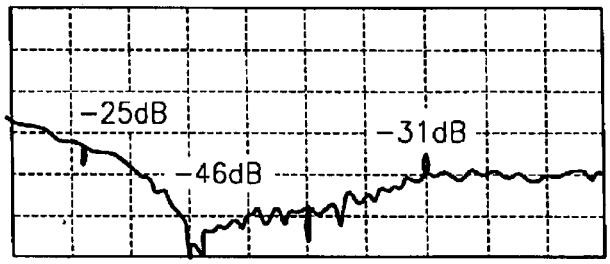
FIG. 11 is a graphical view representing the isolation between subarrays, in accordance with the principles of the present invention.

FIG. 11 is a graphical view representing an isolation between the subarrays, in accordance with the principles of the present invention. As shown in the drawing, the isolation between the subarrays is more than −25 decibels (dB) over the entire bandwidth.

Figure 12:
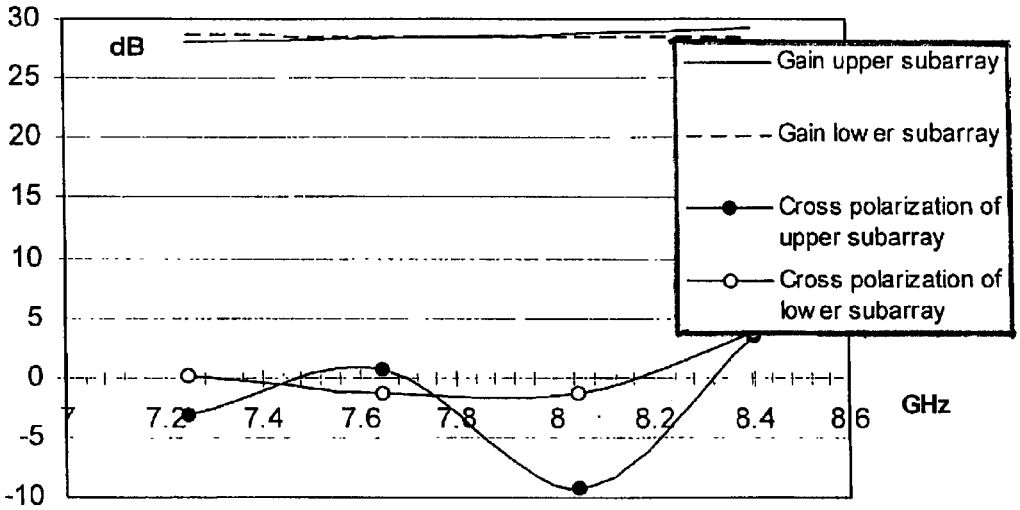
FIG. 12 is a graphical view showing antenna gains and cross polarization isolation, in accordance with the principles of the present invention.

FIG. 12 is a graphical view showing antenna gains and cross polarization isolation, in accordance with the principles of the present invention. As shown in the drawing, the antenna gains are at least 28.5 dB, and the cross polarization isolation is over −25 dB at maximum.

As described above, the present invention provides an antenna having linear and circular polarization, which has an orthogonal characteristic in both linear and circular polarization, and whose height can be lowered by embodying a micro strip planar antenna having dual polarization which has high gain over a wide frequency band, and transmits or receives linear or circular polarization.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A planar antenna having linear and circular polarization, the antenna comprising:

a plate having a dielectric substance with a conductor coated on side surfaces of the dielectric substance; and at least one radiation element comprising:

a first branch positioned on a first surface of said plate;

a second branch positioned on a second surface of sa plate different from the first surface; and a stem having a first end connected to respective ends of said first and second branches, said stem having a second end, and said stem extending in a first direction from said first end to said second end;

each of said first and second branches having a cut out portion located at said respective end connected to said first end of said stem, each said cut out portion forming one of a square slot and a rectangular slot, each said slot having two sides parallel to said first direction of said stem and a third side perpendicular to said first direction of said stem.

2. The antenna of claim 1, said first and second branches corresponding to first and second branches of a dipole.

3. The antenna of claim 2, said at least one radiation element further comprising a stub compensating for coupling impedance.

4. The antenna of claim 1, said first and second branches forming an angle less than 90° with a surface that is perpendicular to said stem.

5. The antenna of claim 4, said first and second branches forming a 45° angle with the surface that is perpendicular to said stem.

6. A planar antenna having linear and circular polarization, the antenna comprising:

a first plate having a first dielectric substance with a conductor coated on side surfaces of the first dielectric substance, said first plate having a first side surface and a second side surface;

a second plate having a second dielectric substance with a conductor coated on side surfaces of the second dielectric substance, said second plate having a firs side surface and a second side surface, said second plate being under said first plate, said first side surface of said second plate facing said second side surface of said first plate;

a plurality of first symmetrical radiation elements disposed on said first and second side surfaces of said first plate, said first symmetrical radiation elements performing at least one of transmitting radio waves and receiving radio waves;

a plurality of second symmetrical radiation elements disposed on said first and second side surfaces of said second plate, said second symmetrical radiation elements performing at least one [selected from among] of transmitting radio waves and receiving radio waves;

a ground plate corresponding to a local reference potential for said first and second symmetrical radiation elements, said ground plate being under said second plate; and a support supporting the antenna by connecting said first plate, said second plate, and said ground plate.

7. The antenna of claim 6, said ground plate further supporting the antenna.

8. The antenna of claim 6, each one of said first symmetrical radiation elements and each one of said second symmetrical radiation elements comprising:

a pair of branches; and a stem, each branch of said pair of branches forming an angle less than 90° with a surface that is perpendicular to said stem.

9. The antenna of claim 8, each branch of said pair of branches forming a 90° angle with said stem.

10. The antenna of claim 9, each branch of said pair of branches forming a 45° angle with the surface that is perpendicular to said stem.

11. The antenna of claim 10, said pair of branches corresponding to a pair of branches of a dipole, each one of said first symmetrical radiation elements and each one of said second symmetrical radiation elements further comprising a stub compensating for coupling impedance, each one of said first symmetrical radiation elements and each one of said second symmetrical radiation elements forming at least one slot compensating for reactance of the [respective] dipole.

12. The antenna of claim 6, [further comprising:] each one of said first symmetrical radiation elements comprising a first branch and a second branch;

said first branch of each of said first symmetrical radiation element and a first power supply wire being located on said first side surface of said first plate, said second branch of each of said first symmetrical radiation elements being located on a surface selected from said second side surface of said first plate and said first side surface of said second plate;

each one of said second symmetrical radiation elements comprising first branch and a second branch;

said first branch of each of said second symmetrical radiation elements and a second power supply wire being located on said second side surface of said second plate, said second branch of each of said second symmetrical radiation elements being located on a surface selected from said first side surface of said second plate and said second side surface of said first plate.

13. The antenna of claim 6, each one of said first symmetrical radiation elements comprising first branch and a second branch;

said first branch of each of said first symmetrical radiation element and a first power supply wire being located on said first side surface of said first plate;

each one of said second symmetrical radiation elements comprising a first branch and a second branch; and said first branch of each of said second symmetrical radiation elements and a second power supply wire being located on said second side surface of said second plate.

14. The antenna of claim 6, further comprising:

a first group of elements selected from among said first and second symmetrical radiation elements corresponding to a first subarray; and a second group of elements selected from among said first and second symmetrical radiation elements corresponding to a second subarray.

15. The antenna of claim 14, said support comprising:

a phase shifter embodied with a micro strip line stub for forming a phase difference of 90° between signals generated by each of said first and second subarrays;

a termination of a power supply circuit positioned where power supply wires are connected to said first and second elements in said first and second subarrays; and a probe connecting said phase shifter and said termination of the power supply circuit.

16. The antenna of claim 6, each one of said first and second plates comprising a printed circuit board.

* * * * *